United States Patent [19]

Kako et al.

[11] 4,417,696

[45] Nov. 29, 1983

[54] TRIBOELECTRIFICATION TYPE ELECTROSTATIC PAINT GUN FOR PAINT IN A POWDER FORM

[75] Inventors: Hiroyoshi Kako, Aichi; Nobuo Kobayashi, Toyota, both of Japan

[73] Assignee: Toyota Jidosha Kogyo Kabushiki Kaisha, Aichi, Japan

[21] Appl. No.: 286,637

[22] Filed: Jul. 24, 1981

[30] Foreign Application Priority Data

Aug. 29, 1980 [JP] Japan ..... 55-121695[U]

[51] Int. Cl.[3] ..... B05B 5/02

[52] U.S. Cl. ..... 239/690; 361/212

[58] Field of Search ..... 239/3, 690–692, 239/704–708; 118/629; 427/27, 30; 361/212, 215, 220, 222, 225–228

[56] References Cited

U.S. PATENT DOCUMENTS 3,910,475 10/1975 Pundsack et al. ..... 361/220 X 4,215,384 7/1980 Elson ..... 361/215

FOREIGN PATENT DOCUMENTS 53-77236 7/1978 Japan ..... 239/692

54-39468 3/1979 Japan .

*Primary Examiner*—Andres Kashnikow

*Attorney, Agent, or Firm*—Parkhurst & Oliff

[57] ABSTRACT

A triboelectrification type electrostatic paint gun for paint in a powder form. The gun is provided with a nozzle through which the paint passes. The passageway has an inner triboelectrification layer provided with a plurality of small regions for generating a creep discharge.

7 Claims, 5 Drawing Figures

TRIBOELECTRIFICATION TYPE ELECTROSTATIC PAINT GUN FOR PAINT IN A POWDER FORM

DESCRIPTION OF THE INVENTION

The present invention relates to an electrostatic painting gun of a triboelectrification type.

Known prior art electrostatic painting gun of the triboelectrification type are disclosed in Japanese Patent Application No. 51-152928 and Japanese Utility Model Registration No. 52-112859. Such a triboelectrification type guns have an advantage in that the paint efficiently adheres to the object to be painted due to the large extent of electrification, as compared with a paint gun of a conventional corona discharge type.

However, the triboelectrification type gun suffers from the drawback in that a material used to form the triboelectrification layer is restricted in view of the requirements imposed by practical use. In addition, production of the gun can not be easily effected. For example, the Japanese Patent Application No. 51-152928 suffers from a drawback in that the formation of a very thin triboelectrification layer is difficult. The Japanese Utility Model Registration No. 52-112859 suffers from a drawback in that it requires a complicated process for mixing an electro-conducting material in the triboelectrification layer.

Therefore, an object of the present invention is to provide a paint gun of a triboelectrification type, capable of providing a large electrical charge without restricting the material used to form the triboelectrification layer.

Those skilled in this art are well aware, that a paint gun of the triboelectrification type has a layer made of a dielectric material (a plastic material, in many cases) which is, in the triboelectric series, positioned at a distance from the area where the material for forming the paint is located, so that a strong charge is formed on the paint particles. In this case, the layer has an opposite charge applied to it, but it is charged to the same level as that of the charge of the particles of paint. By the efforts of the inventors, it has been found that in order to achieve continuous charging of the particles, it is essential to quickly discharge the charge applied on the layer to the ground. The inventors have found that the discharge is effected under a principle of a so-called creep discharge, and a strong charge is obtained when the area of the discharge is as small as possible. It should be noted that the inventor of this application achieved the present invention based on these findings after many efforts to create conditions where such a creep discharge area is easily generated.

Now the present invention will be described with reference to the attached drawings in which.

Figure 1:
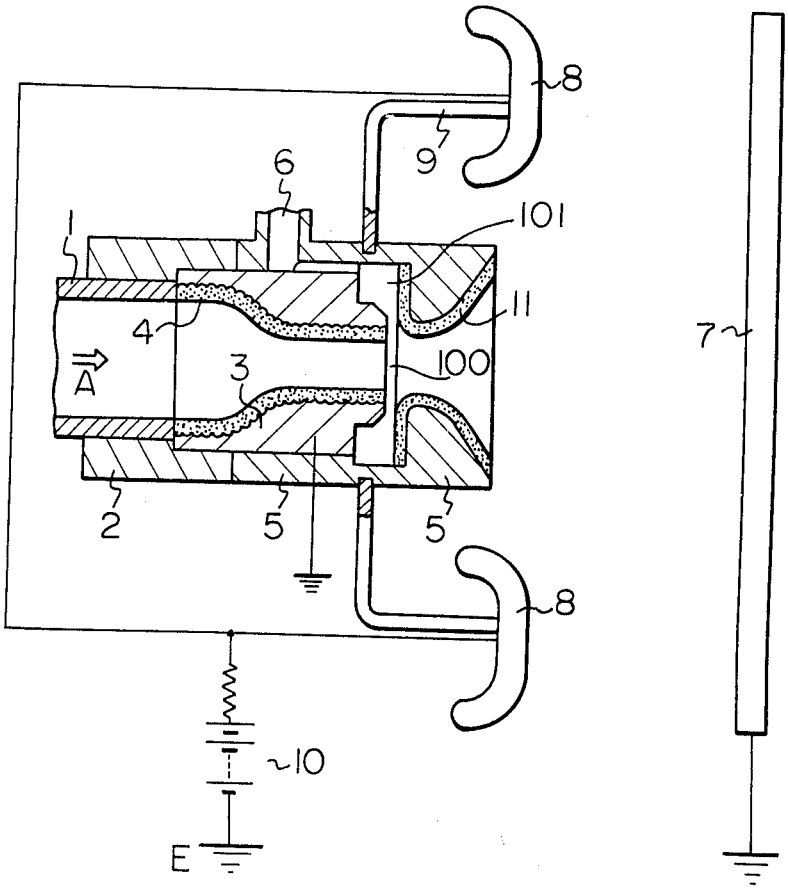
FIG. 1 shows a cross-sectional view of a paint gun of a triboelectrification type according to the present invention.

In FIG. 1, an electrostatic painting apparatus includes a tube 1 connected, on one end, to a source of paint in a powder form. The other end of the tube 1 is connected, by means of joint tube 2, to a nozzle 3 having an outwardly tapered inner surface 4 made of a dielectric material which is spaced as far as possible from the material forming the paint in the triboelectric series so that an electric charge, due to the friction effect, is generated in the powder when the paint is moved in the nozzle 3, as shown by an arrow A. An outer tube 5 is connected to the nozzle 3, which tube 5 has an outwardly widened inner diffuser layer 11 connected, on an inner end, to the triboelectrification layer 4 by leaving a small slit 100 therebetween. An annular space 101 is formed around the slit 100 so that it communicates with the slit 100. The annular space 101 is connected to an inlet pipe 6 for receiving a flow of air from an air source (not shown), so that the air is entrained by the flow of the paint in a powder form and directed in a diffused state to a surface 7 to be painted which is spaced from the outlet end of the diffusers. Thus, the charged paint adheres, due to the electrostatic attracting force, to the surface 7 to be painted, which is electrically connected to the ground. Electric field forming electrodes 8 are connected to the outer tube 5 by means brackets 9 made of an electrically non-conductive material. The electrodes 8 are connected to a high voltage electrical source 10. The other end of the source 10 is connected to the ground.

Figure 2:
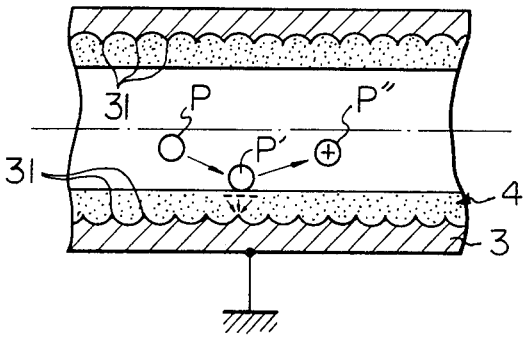
FIGS. 2 through 5 show a construction of the triboelectrification layers in embodiments.

FIG. 2 is a partial and enlarged view of the nozzle 3, which is electrically connected to the ground. The nozzle 3 has an uneven inner surface, so that a plurality of sharpened projections 31 are formed. The uneven surface is covered by the triboelectrification layer 4.

When the flow of the paint passes through the nozzle 3, particles of the paint P contact with the layer 4 as shown by P'. In this case the powder is charged as shown by P'' so that it has a positive pole, while the layer 4 is charged so that it has a negative pole of the same potential as that of the charged powder. As a result of this, a sufficiently large potential difference is generated between the projections 31 and the inner surface of the layer 4, which is enough to allow a dielectric breakdown to take place, so that a plurality of fine holes are formed in the layer 4. After the holes are thus formed, a creeping discharge takes place by way of the holes, so that the electric charge generated on the layer 4 is rapidly dissipated to the ground. In other words, the layer 4 is always maintained under an electrically cleaned condition. Thus, the particles of paint passed through the nozzle have a high level charge. Thus, the paint can be effectively adhered to the surface 7 to be painted, which is electrically connected to the ground.

It should be noted that the formation of the projections 31 can be effected by shot pinning, etching or a rough machining process.

Figure 3:
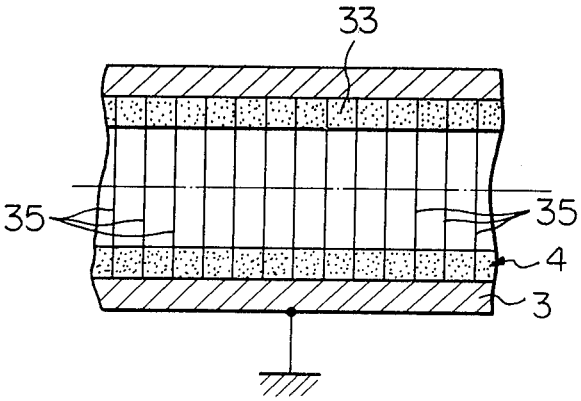

In another embodiment shown in FIG. 3, the triboelectrification layer 4 comprises a plurality of ring members 33 made of a dielectric material, such as a plastic material, which ring members 33 are fitted to the nozzle 3. A plurality of axially spaced apart slits 35 of a ring shape are provided. The creep discharge takes place along the slits 35.

Figure 4:
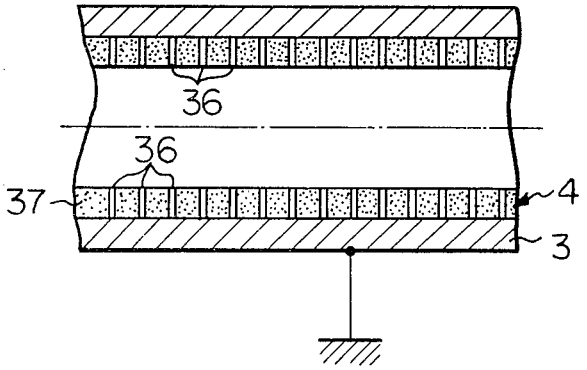

In an embodiment shown in FIG. 4, a plastic tube 37 having a plurality of radial holes 36 along the entire portion thereof is inserted to the nozzle 3. The creep discharge takes place along the holes 36.

Figure 5:
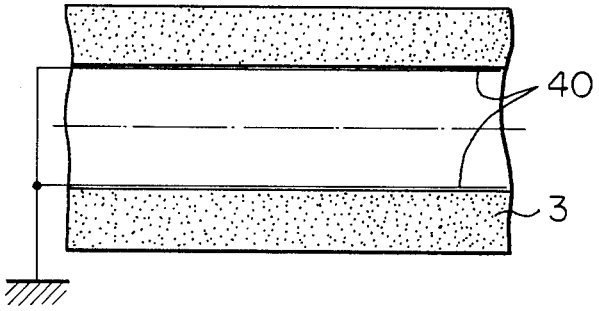

In an embodiment shown in FIG. 5, the nozzle 3 is made of a plastic material. A plurality of metal wires 40 are arranged along the inner surface of the nozzle 3, which metal wires are connected to the ground. The creep discharge takes place along the wires 40.

According to the present invention, a strong charge is obtained in the paint passed through the dielectric layer 4, since an opposite charge to that of the paint is quickly dissipated to the ground under the principle of small creeping discharge. Therefore, strong charging of the paint may be achieved, even if a material of a low polarization ability, such as polyethylene, is used. Of course, a stronger charging is obtained if a high polarization material, such as terafluoro-ethylene is utilized.

According to the present invention, since the triboelectrification layer 4 may be a thick one, a production of a nozzle which conforms to a particular use is easily made by selecting appropriate one from known working process.

EXAMPLE

Paint in a powder form made of an epoxy material was, under a flow rate of 88 g/minutes, passed through the apparatus in FIG. 5 and through a prior art apparatus. Electric charge data obtained are shown in the following table.

| | Thickness of layer 4 | | Amount of charge (micro coulomb/g) |
|---|---|---|---|
| Prior art | Lower than | 0.5 mm | 1.6 |
| | Larger than | 5 mm | 0.03 |
| Present invention | Larger than | 5 mm | 1.7 |

As will be clear from the above table, the present invention make it possible to achieve a charge which is equal to that achieved by the prior art irrespective of using a triboelectrification layer 4 having a thickness which is larger than that of the prior art.

While the present invention is described with reference to the given embodiments, many modifications and changes may be made by those skilled in this art.

We claim:

1. An electric painting apparatus of the triboelectrification type, comprising means for defining a passageway through which a flow of paint in a powder form passes, said passageway having an inlet connected to a source of the paint and an outlet spaced from an object to be painted, means for defining, at a position adjacent to the outlet, a triboelectrification layer made of a dielectric material which is, in the triboelectric series, located at a position spaced from the position where a material for forming the paint is located, said layer having a plurality of localized creep discharge areas for removing the charge from the layer to the ground.

2. An apparatus according to claim 1 wherein said means for defining the passageway comprises a nozzle made of a metallic material, said means for defining the triboelectrification layer comprising a lining made of a dielectric material on the inner surface of the nozzle, said inner surface of the nozzle being roughened so that it has a plurality of projections, whereby a plurality of fine holes, which act as the small creep discharge areas, are formed in the lining by the dielectric breakdown.

3. An apparatus according to claim 1, wherein said means for defining the passageways comprise a nozzle made of a metallic material, and said means for defining the triboelectrification layer comprise a plurality of ring members made of a dielectric material inserted in series into the nozzle, so that a plurality of axially spaced angular slits, acting as the small creep discharge areas, are formed between the adjacent ring members.

4. An apparatus according to claim 1, wherein said means for defining the passageway comprise a nozzle made of a metallic material, and said means for defining the triboelectrification layer comprise a tubular member of a dielectric material inserted in the nozzle, said tubular member being provided with a plurality of radial holes to act as the small creep discharge area.

5. An apparatus according to claim 1, wherein said means for defining the passageway comprise a nozzle made of a dielectric material, and said means for defining the triboelectrification layer comprise a plurality of needle electrodes arranged along the length of the passageway adjacent to the inner surface of the nozzle.

6. An apparatus according to claim 1, further comprising a diffuser arranged adjacent to the end of the passageway for controlling the flow of paint discharge toward the object to be painted.

7. An apparatus according to claim 6, further comprising an electric field forming electrodes arranged around the diffuser so that the flow of paint directed to the object is controlled.

* * * * *